United States Patent [19]

Dobashi et al.

[11] Patent Number: 4,759,446

[45] Date of Patent: Jul. 26, 1988

[54] PACKAGE INCLUDING HANDLE FOR REMOVAL OF HOUSED ARTICLE

[75] Inventors: Koichi Dobashi, Morioka; Tomohisa Yamaguchi, Takizawa, both of Japan

[73] Assignee: Alps Electric Co., Ltd., Japan

[21] Appl. No.: 6,883

[22] Filed: Jan. 27, 1987

[30] Foreign Application Priority Data

Apr. 3, 1986 [JP] Japan ..... 61-49854[U]

[51] Int. Cl.[4] ..... B65D 31/06

[52] U.S. Cl. ..... 206/586; 53/399; 206/320; 206/521; 206/592; 206/594; 294/153

[58] Field of Search ..... 16/110.5, 114 B, 114 R; 53/399, 419, 413; 206/320, 521, 523, 591, 592, 593, 594, 597, 804, 586; 220/403; 229/52 AL; 294/141, 149, 156, 165, 167, 153

[56] References Cited

U.S. PATENT DOCUMENTS

| | | | |
|---|---|---|---|
| 1,120,020 | 12/1914 | Bullock | 294/165 |
| 1,194,172 | 8/1916 | Harbeck | 220/403 |
| 2,324,495 | 7/1943 | Deming | 220/409 |
| 2,673,454 | 3/1954 | Gallie et al. | 220/403 |
| 2,801,781 | 8/1957 | Goetz | 294/156 |
| 3,181,766 | 5/1965 | Kane et al. | 206/523 |
| 4,140,257 | 2/1979 | Peterson | 206/804 |
| 4,269,314 | 5/1981 | Barrash | 229/52 AL |
| 4,286,714 | 9/1981 | Zdarsky et al. | 229/52 AL |
| 4,576,310 | 3/1986 | Isgar et al. | 220/403 |

FOREIGN PATENT DOCUMENTS

| | | | |
|---|---|---|---|
| 0037188 | 3/1977 | Japan | 53/399 |

*Primary Examiner*—Jimmy G. Foster

*Attorney, Agent, or Firm*—Guy W. Shoup; Leighton K. Chong

[57] ABSTRACT

A packing structure for packing an article in a packing box includes a belt-like attaching member provided with a handle. The attaching member is wound around the article. By gripping and pulling the handle the article can easily be taken out from the packing box, without damage to the article.

2 Claims, 1 Drawing Sheet

PACKAGE INCLUDING HANDLE FOR REMOVAL OF HOUSED ARTICLE

BACKGROUND OF THE INVENTION

1. Field of the Invention

This invention relates to a packing structure for packing articles, such as office automation equipment, sound equipment, and domestic electrification goods, in a packing box, and more particularly, to the type which permits easy takeout of an article from the packing box.

2. Description of the Prior Art

An article, such as a printer used as a terminal equipment of, for example, a computer, is generally packed in such a manner as shown in FIG. 2.

In FIG. 2, a packing box 2 such as a corrugated fiberboard box whose dimensions of length, width and height are made larger than those of a printer 1 has on one side a side opening 3, and this side opening 3 is closed by a plurality of lid boards 4, . . . 4 continuous with the packing box 2. In packing the printer 1 in the packing box 2, after wrapping the printer 1 in a vinyl bag 5, cushion members 6 made, for example, of expandable polystyrene each having a recess 7 are attached to either side of the printer 1 over the vinyl bag 5, and the printer 1 wrapped in the vinyl bag 5 is inserted together with both cushion members 6 and 6 in the packing box through the side opening 3. Of course, the dimensions of each cushion member 6 correspond to the length and height of the packing box 2, whereas the spacing between the respective external ends of the two cushion members 6 and 6 attached to the printer 1 corresponds to the width of the packing box 2. Accordingly, as the side opening 3 is closed by the lid boards 4, the printer 1 held by both the cushion members 6 and 6 is returned inside the packing box 2 without any play.

According to the foregoing packing structure, the printer 1 is retained inside the packing box 2 without causing direct contact with the packing box 2, thus, the printer 1 can stably be retained without suffering damage even under impact.

The foregoing conventional packing structure of articles, however, has the problem that it is difficult to take out the printer 1 from the packing box 2 because in the packed state of the printer 1 each cushion member 6 is comparatively tightly contacted with the packing box 2. This difficulty in taking out the printer becomes heavier with an increase in weight of the printer 1, thereby resulting in a fear that the printer 1 will be damaged or dropped as a result of touching peculiar portions of the printer 1.

SUMMARY OF THE INVENTION

It is an object of the present invention to solve the foregoing problem of the prior art, thus to provide a packing structure for articles which permits easy takeout of an article from a packing box.

In brief, a packing structure for articles according to the present invention is characterized in that a belt-like attaching member provided with a handle is wound around an article to hold the article.

According to the present invention, an article wound with the belt-like attaching member is inserted in a packing box in such a manner that when the opening of the packing box is opened the handle is exposed externally. As the handle is pulled at the time of taking out the article through the opening of the packing box, the article can easily be pulled out because the article is wound and held by the belt-like attaching member being integral with the handle.

DESCRIPTION OF THE PREFERRED EMBODIMENT

Figure 1:
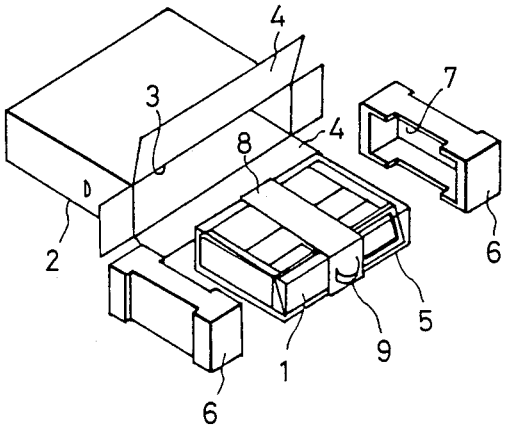
FIG. 1 is an exploded perspective view showing an embodiment of a packing structure for articles according to the present invention.
Figure 2:
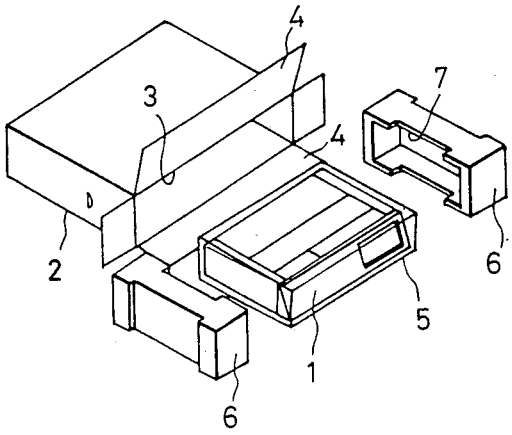
FIG. 2 PRIOR ART
FIG. 2 is an exploded perspective view showing a conventional packing structure for articles.

An embodiment of the present invention will now be described with reference to FIG. 1, in which the equivalent parts to those of the conventional structure of FIG. 2 are designated by the same reference numerals as in FIG. 2 with the description thereof omitted.

In FIG. 1 showing the embodiment of the present invention, a belt-like attaching member 8 is wound around the periphery of a vinyl bag 5 enclosing a printer 1, and the belt-like attaching member 8 is provided with a handle 9 which is attached in the inserted state of the printer 1 in a packing box 2 to a portion facing opposite a side opening 3 of the packing box 2.

According to the foregoing structure, cushion members 6 are fitted on either side portion of the printer 1 wrapped in the vinyl bag 5, and the printer 1 wrapped in the vinyl bag 5 is inserted together with both the cushion members 6 and 6 through the side opening 3 in the packing box 2 in such a manner that the handle 9 attached to the belt-like attaching member 8 wound around the periphery of the vinyl bag 5 is positioned on the rear side in the insertion direction of the printer 1 into the packing box 2, i.e. at a position where the handle 9 inside the packing box 2 faces opposite the side opening 3 such that it can be exposed externally. Consequently, as each lid board 4 is opened to expose the side opening 3 of the packing box 2 at the time of unpacking, the handle 9 of the belt-like attaching member 8 is exposed in the side opening 3, hence, it is possible easily to take out the printer 1 from the packing box 2 by pulling out the handle 9 while gripping it by a hand.

Accordingly, it is possible easily to take out the printer 1 from the packing box 2 irrespective of weight of the printer 1, and it is possible to prevent occurrence of an accident that the printer 1 will be dropped because the handle 9 is gripped by a hand at the time of takeout.

Although in the foregoing embodiment the cushion members 6 and 6 are attached to the printer 1 wrapped in the vinyl bag 5 over the vinyl bag 5 before the printer 1 is inserted in the packing box 2, by making the shape of the packing box 2 comply with that of the printer 1, it is also possible to insert the printer 1 in the packing box 2 together with the belt-like attaching member 8 directly wound around the periphery of the printer 1 without using the vinyl bag 5 and the cushion members 6. Further, the present invention can also be applied to various articles other than the printer 1.

As described hereinabove, according to the present invention, it is possible to pull out the article by gripping the handle, thus, the takeout operation of the article from the packing box can easily be achieved even when the article is heavy, thereby resulting in a practical effect that the article can not be dropped when taking it out.

What is claimed is:

1. A packing structure for an article comprising:

a packing box having a top side which is openable for removing the article from said box along a first direction, said article having a shape generally corresponding to said box and a top side thereof which is exposed through and faces said openable top side of said box;

a pair of cushion members provided on respective opposite lateral sides of the article in a lateral direction perpendicular to said first direction, wherein said top side of the article remains exposed between said cushion members on said lateral sides of the article; and a belt-like attaching member which is wound around the article along said first direction and has a handle positioned at the top side of the article which is exposed through said openable top side of said box for convenient removal of the article therefrom.

2. A packing structure according to claim 1, wherein the article is wrapped in a vinyl bag before being wound with the belt-like attaching member.

* * * * *

UNITED STATES PATENT AND TRADEMARK OFFICE

CERTIFICATE OF CORRECTION

PATENT NO. : 4,759,446

DATED : July 26, 1988

INVENTOR(S) : Koichi Dobashi, Tomohisa Yamaguchi

It is certified that error appears in the above-identified patent and that said Letters Patent is hereby corrected as shown below:

On the Title Page, Item [22],
Correct filing date is January 26, 1987.

Signed and Sealed this

Twenty-second Day of August, 1989

*Attest:*

DONALD J. QUIGG

*Attesting Officer*

*Commissioner of Patents and Trademarks*